US006288692B1

(12) United States Patent
Kanazawa et al.

(10) Patent No.: US 6,288,692 B1
(45) **Date of Patent: *Sep. 11, 2001**

(54) PLASMA DISPLAY FOR HIGH-CONTRAST INTERLACING DISPLAY AND DRIVING METHOD THEREFOR

(75) Inventors: Yoshikazu Kanazawa; Haruo Koizumi; Shigeharu Asao, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/887,371

(22) Filed: Jul. 2, 1997

(30) Foreign Application Priority Data

Jan. 21, 1997 (JP) ..... 9-008400

(51) Int. Cl.[7] ..... G09G 3/28

(52) U.S. Cl. ..... 345/67; 315/169.4

(58) Field of Search ..... 345/60, 67, 68, 345/69; 313/231.31, 231.41, 231.51, 231.61, 231.71; 315/169.4, 169.1, 168

(56) References Cited

U.S. PATENT DOCUMENTS

| | | | | |
|---|---|---|---|---|
| 4,914,352 | * | 4/1990 | Gay et al. | 315/169.4 |
| 5,369,338 | | 11/1994 | Kim | 315/169.4 |
| 5,436,634 | | 7/1995 | Kanazawa | 345/67 |
| 5,446,344 | | 8/1995 | Kanazawa | 315/169.4 |
| 5,754,004 | * | 5/1998 | Miyagawa et al. | 315/169.4 |
| 5,854,540 | * | 12/1998 | Matsumoto et al. | 315/169.4 |
| 6,034,482 | * | 3/2000 | Kanazawa et al. | 345/211 |

FOREIGN PATENT DOCUMENTS

| | | |
|---|---|---|
| 0 762 373 | 3/1997 | (EP) . |
| 2-291597 | 12/1990 | (JP) . |
| 7-26169 | 10/1995 | (JP) . |
| 7-287548 | 10/1995 | (JP) . |
| 8-162026 | 6/1996 | (JP) . |

OTHER PUBLICATIONS

U.S. application No. 08/690,038, Tomoyuki et al., filed Jul. 31, 1996.

* cited by examiner

*Primary Examiner*—Jeffery Brier
*Assistant Examiner*—Anthony Blackman
(74) *Attorney, Agent, or Firm*—Staas & Halsey LLP

(57) ABSTRACT

Disclosed are a plasma display capable of preventing deterioration of display contrast deriving from priming discharge, and of minimizing a power consumption, and a driving method therefor. The plasma display comprises: a plasma display panel in which first, second, and third electrodes are arranged alternately parallel to one another on a first substrate, and fourth electrodes are arranged orthogonally to the first electrodes on the first substrate or a second substrate; a first electrode selection driver for selectively driving the first electrodes; a second electrode driver for driving the second electrodes, and a third electrode driver for driving the third electrodes. First display cells are formed at intersections between the first electrodes and second electrodes and the fourth electrodes, and second display cells are formed at intersections between the first electrodes and third electrodes and the fourth electrodes. The first display cells and second display cells are alternately and repeatedly allowed to glow for display for the purpose of achieving interlacing display. In the plasma display, during a reset period, the second electrode driver and third electrode driver apply voltages to the second and third electrodes respectively so that priming discharge can be induced in third cells. The third cells for priming are formed with the second electrodes and third electrodes.

33 Claims, 19 Drawing Sheets

PLASMA DISPLAY FOR HIGH-CONTRAST INTERLACING DISPLAY AND DRIVING METHOD THEREFOR

BACKGROUND OF THE INVENTION

1. Field of the Invention

The present invention relates to an art for driving a display panel composed of a set of cells that are display elements having a memory function. More particularly, this invention is concerned with a display for achieving interlacing display using an alternating current (AC) type plasma display panel (PDP), and a driving method therefor.

2. Description of the Related Art

The above AC type PDP is designed to sustain discharge by applying a voltage wave alternately to two sustaining electrodes, and to glow for display. The present applicant has disclosed a plasma display for achieving interlacing display in Japanese Patent Application No. 8-194320. A driving method disclosed in the publication features that by selecting a voltage to be applied to X electrodes during addressing, it is selected in which of slits across each of Y electrodes discharge is triggered with discharge occurring between each pair of addressing electrodes and the Y electrodes. Consequently, wall charge can be produced in cells in each slit on the side in which discharge should be sustained. Sustaining pulses that are in phase with each other are applied to pairs of electrodes adjoining slits in which discharge is not induced, thus preventing incorrect discharge. A Y sustaining circuit and X sustaining circuit that are circuits for sustaining discharge are separated from each other and can mutually independently apply pulses for addressing and sustaining operations. In this plasma display, display lines associated with an odd field and even field do not affect each other. Partitions for defining display cells lengthwise need not be placed between each pair of the Y electrodes and X electrode. Consequently, the plasma display panel can enjoy the feature of high definition.

Furthermore, the Japanese Patent Application No. 8-194320 has disclosed a structure in which light-interceptive members are placed in slits, which are not involved in display, in order to prevent deterioration of display contrast deriving from discharge irrelevant to display. In a plasma display, discharge referred to as priming discharge is induced in order to facilitate smooth addressing discharge and sustaining discharge. In a prior art, for example, reset discharge to be carried out during a reset period plays the role of the priming discharge. This kind of priming discharge does not contribute to a display image but deteriorates display contrast. Using the above light-interceptive members, unwanted light irrelevant to display is intercepted.

The employment of the structure disclosed in the Japanese Patent Application No. 8-194320 obviates the necessity of placing partitions in parallel with the Y electrodes and X electrode. The plasma display panel can enjoy the feature of high definition. However, there is a problem that connection between a scan driver serving as a Y electrode selecting circuit and a Y sustaining circuit serving as a discharge sustaining circuit or a Y common driver becomes complex. For solving this kind of problem, the Japanese Patent Application No. 8-194320 has disclosed a display for achieving interlacing display in which two X electrodes are placed across each Y electrode, voltages are applied to the Y electrodes and odd-numbered X electrodes in order to induce discharge during an odd field, and voltages are applied to the Y electrodes and even-numbered X electrodes in order to induce discharge during an even field. A line between each pair of even-numbered and odd-numbered X electrodes is a complete non-display line. However, since no partition is placed, the feature of high definition can be provided. Besides, it is unnecessary to separate Y electrodes into two channels. This is advantageous because connection between a scan driver and Y sustaining circuit and connection between the scan driver and a panel becomes simple.

In the plasma display disclosed in the Japanese Patent Application No. 8-194320, assuming that a large voltage is applied to the Y electrodes and X electrodes for the purpose of full-screen writing during a reset period in the same manner as that in the prior art, when discharge induced is regarded as priming discharge, the priming discharge occurs at the same positions as display cells. As mentioned previously, priming discharge does not contribute to a display image but deteriorates display contrast. It is therefore preferred that light be intercepted. In the display disclosed in the Japanese Patent Application No. 8-194320, priming discharge occurs at the positions of display cells. A light-interceptive member cannot be placed at the positions. In the known display disclosed in the Japanese Patent Application No. 8-194320, there is a problem that display contrast cannot be improved fully.

In the foregoing prior art, reset discharge (priming discharge) occurs even in slits in which discharge is not induced. This leads to deteriorated contrast. In the prior art and others, since priming discharge is induced in display cells, the scale of discharge is as large as that of sustaining discharge. This poses a problem of a large power consumption.

SUMMARY OF THE INVENTION

An object of the present invention is to provide a plasma display capable of preventing deterioration of display contrast deriving from priming discharge and of minimizing a power consumption, and a driving method therefor.

A plasma display of the present invention comprises: a plasma display panel in which first, second, and third electrodes are arranged alternately parallel to one another on a first substrate, and fourth electrodes are placed orthogonally to the first electrodes on the first substrate or a second substrate; a first electrode selection driving circuit for selectively driving the first electrodes; a second electrode driving circuit for driving the second electrodes and; a third electrode driving circuit for driving the third electrodes. In the plasma display, first display cells are formed at intersections between the first electrodes and second electrodes, and the fourth electrodes. Second display cells are formed at intersections between the first electrodes and third electrodes, and the fourth electrodes. The first display cells and second display cells alternately and repeatedly glow for display, thus achieving interlacing display. During a reset period, the second electrode driving circuit and third electrode driving circuit apply voltages to the second and third electrodes respectively so that priming discharge can be induced in third cells. The third cells for priming are formed with the second electrodes and third electrodes.

According to the present invention, priming discharge is induced in the third cells, which are not display cells, between the second and third electrodes. Light-interceptive members can be placed for light interception. Display contrast can therefore be improved. Moreover, since priming discharge is induced in the third cells T1 that are not display cells, the scale of discharge can be diminished and a power consumption can be minimized.

Furthermore, light-interceptive members are placed in third slits that are gaps between the second and third electrodes.

During a sustaining discharge period, the first electrode selection driving circuit applies a first sustaining discharge pulse to the first electrodes. One of the second electrode driving circuit and third electrode driving circuit applies a sustaining discharge pulse that is out of phase with the first sustaining discharge pulse, and the other one thereof applies a given constant voltage or retains the associated electrodes at high impedance. The potential at slits (cells) in which discharge is not induced becomes less than a minimum discharge sustaining voltage. Incorrect discharge will therefore not occur.

Furthermore, the given constant voltage is substantially half of the voltage of the first sustaining discharge pulse. This is helpful in minimizing the potential at cells in which discharge is not induced.

Furthermore, first slits that are gaps between the first and second electrodes, and second slits that are gaps between the first and third electrodes are arranged equidistantly.

Furthermore, the third slits that are gaps between the second and third electrodes are formed in the middles of adjoining first electrodes.

Furthermore, the first to third electrodes are composed of transparent electrodes and metallic bus electrodes.

Furthermore, the transparent electrodes of the first electrodes are wider than the bus electrodes, and the bus electrodes are formed in the centers of the transparent electrodes.

Furthermore, the transparent electrodes of the first and second electrodes are wider than the bus electrodes, and the bus electrodes are formed on the third slit side.

Furthermore, the width of the bus electrodes of the first electrodes is set to be the same as a dimension from an edge on the first slit side of the bus electrode of each second electrode to an edge on the second slit side of the bus electrode of each third electrode on an adjoining line. Consequently, the first display cells and second display cells are formed in a well-balanced manner.

Furthermore, the thickness of the bus electrodes of the first electrodes is set to be nearly half of the thickness of the bus electrodes of the second and third electrodes.

Furthermore, the resistances of the first to third electrodes are set to be the same. Consequently, a decrease in luminance deriving from a voltage drop caused by an electrode resistance will be almost the same between the right-hand and left-hand sides of a display Furthermore, light-interceptive members are formed on the surfaces of the first electrodes. Consequently, light stemming from priming discharge in the third cells can be intercepted, and invalid glowing can be minimized.

Furthermore, the width of the light-interceptive members on the first electrodes is set to be the same as a dimension from an edge on the first slit side of the bus electrode of each second electrode to an edge on the second slit side of the bus electrode of each third electrode on an adjoining line. This results in a well-balanced arrangement of cells.

Furthermore, the width of the third slits is set to be smaller than that of the first and second slits. Consequently, even when the same voltage is applied to the electrodes forming the first and second display cells and the third cells, discharge can be induced in the third cells alone.

Furthermore, fourth slits are formed in the centers of the first electrodes. Consequently, excessive spread of discharge can be prevented, the outlines of light become uniform, and sustaining discharge is stabilized.

Furthermore, light-interceptive members are formed in fourth slits in the centers of the first electrodes. Consequently, reflected light can be prevented and contrast can be improved.

Furthermore, in a reset process, voltages are applied to the second electrodes and third electrodes, and priming discharge is induced in the third cells. This results in safe and reliable addressing discharge.

Furthermore, in the reset process, when voltages are applied to the second electrodes and third electrodes, a substantially intermediate voltage of the voltages applied to the second electrodes and third electrodes is applied to the first electrodes. Consequently, priming discharge will not trigger discharge in the first and second cells.

Furthermore, the voltage to be applied to the first electrodes in the reset process is the same as the voltage of a sustaining discharge pulse.

Furthermore, the polarity of voltages to be applied to induce priming discharge is changed from when the first display cells are allowed to glow for display to when the second display cells are allowed to glow for display. This results in efficient discharge.

Furthermore, a voltage whose polarity is opposite to that of a last sustaining discharge pulse in the immediately preceding sustaining discharge process is applied for priming discharge. Priming discharge can be induced without preceding erasure discharge.

Furthermore, the potential at the first electrodes is set to be the same value as a voltage applied during the last sustaining discharge in the immediately preceding sustaining discharge process. A voltage of opposite polarity is applied to the second or third electrodes. This results in efficient discharge.

Furthermore, discharge is started in the third cells. After removal of the pulse used to start the discharge, a pulse of a voltage capable of inducing discharge is applied in order to induce priming discharge. Moreover, after removal of the pulse, all the electrodes have no potential difference. This results in self-erasure discharge. Wall charge can therefore be erased uniformly.

Furthermore, a voltage whose polarity is opposite to that of a voltage applied on the last sustaining discharge stage within the immediately preceding sustaining discharge process is applied in order to induce discharge. Discharge is induced again with removal of the pulse, and discharge is also induced in the first or second display cells in which discharge is sustained immediately previously. Consequently, erasure discharge can be carried out in those of the first and second display cells in which discharge is sustained.

Furthermore, immediately before the display involving the first display cells shifts to a display involving the second display cells, and immediately before the display involving the second display cells shifts to a display involving the first display cells, pulses of voltages are applied in order to induce discharge in all cells. Immediately before the display involving the first display cells shifts to a display involving the second display cells, pulses of voltages are applied in order to induce discharge in the second display cells and third display cells. Immediately before the display involving the second display cells shifts to a display involving the first display cells, pulses of voltages are applied in order to induce discharge in the first display cells and third display cells. Thus, cells to be newly allowed to glow for display can be activated.

Furthermore, an erasing pulse is applied to the first electrodes and the second or third electrodes during the last stage within the sustaining discharge process.

BRIEF DESCRIPTION OF THE DRAWINGS

The present invention will be more clearly understood from the description as set below with reference to the accompanying drawings, wherein.

DESCRIPTION OF THE PREFERRED EMBODIMENTS

Before proceeding to a detailed description of the preferred embodiments of the present invention, prior art plasma a displays will be described with reference to the accompanying drawings thereof for a clearer understanding of the differences between the prior art and the present invention.

Figure 1:
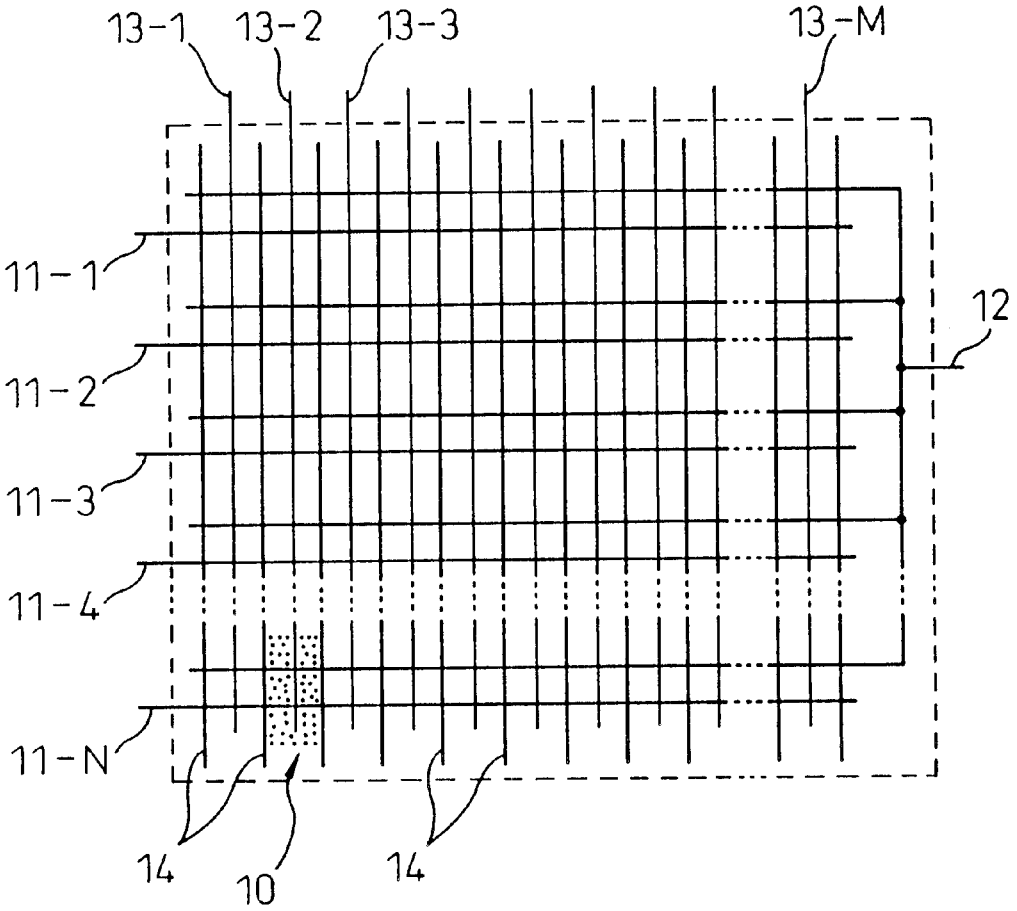
Fig.1 PRIOR ART
FIG. 1 is a schematic plan view of a known triple-electrode surface-discharge AC type PDP.
Figure 2:
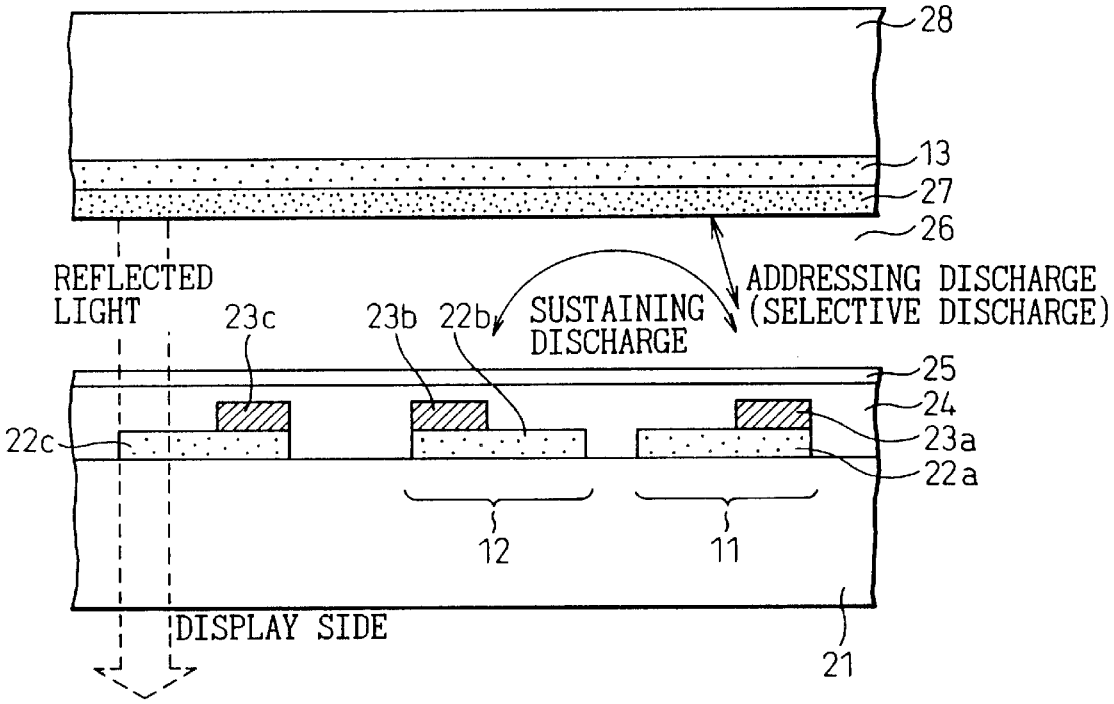
Fig. 2 PRIOR ART
FIG. 2 is a schematic sectional view of the known triple-electrode surface-discharge AC type PDP.

A PDP shown in the schematic plan view of FIG. 1 is known as a triple-electrode surface-discharge type PDP. FIG. 2 is a schematic sectional view of the panel, and FIG. 3 is a schematic sectional view in a horizontal direction of the panel.

The panel is composed of two glass substrates 21 and 28. The first substrate 21 has first and second electrodes (X electrodes and Y electrodes) 11 and 12 serving as parallel sustaining electrodes. The electrodes are composed of transparent electrodes 22*a* and 22*b* and bus electrodes 23*a* and 23*b*. The transparent electrodes transmit light reflected from phosphors, and the bus electrodes are made of a metal for the purpose of preventing a voltage drop caused by an electrode resistance. The electrodes are covered with a dielectric layer 24, and a membrane made of magnesium oxide (MgO) 25 is formed as a protective membrane on a discharge side. On the second substrate 28 facing the first glass substrate 21, third electrodes (addressing electrodes) 13 are formed orthogonally to the sustaining electrodes 11 and 12. A barrier 14 is formed between each pair of the addressing electrodes 13. A phosphor 27 having the property of glowing in red, green, and blue is formed between each pair of the barriers so that the phosphor can cover each addressing electrode 13. The two glass substrates are assembled by bringing the ridges 14 of the barriers and the MgO surface 25 into close contact with each other.

Figure 3:
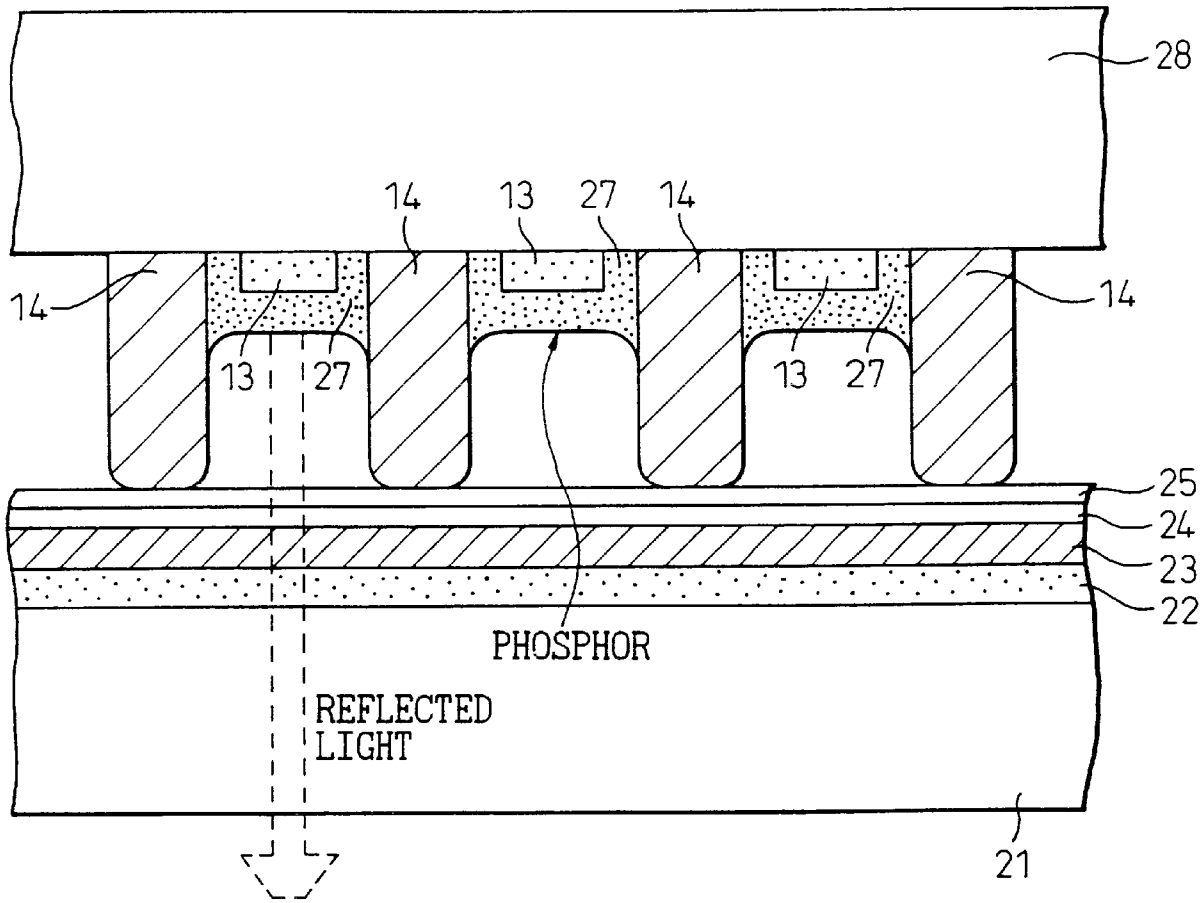
Fig. 3 PRIOR ART
FIG. 3 is a schematic sectional view of the known triple-electrode surface-discharge AC type PDP.
Figure 4:
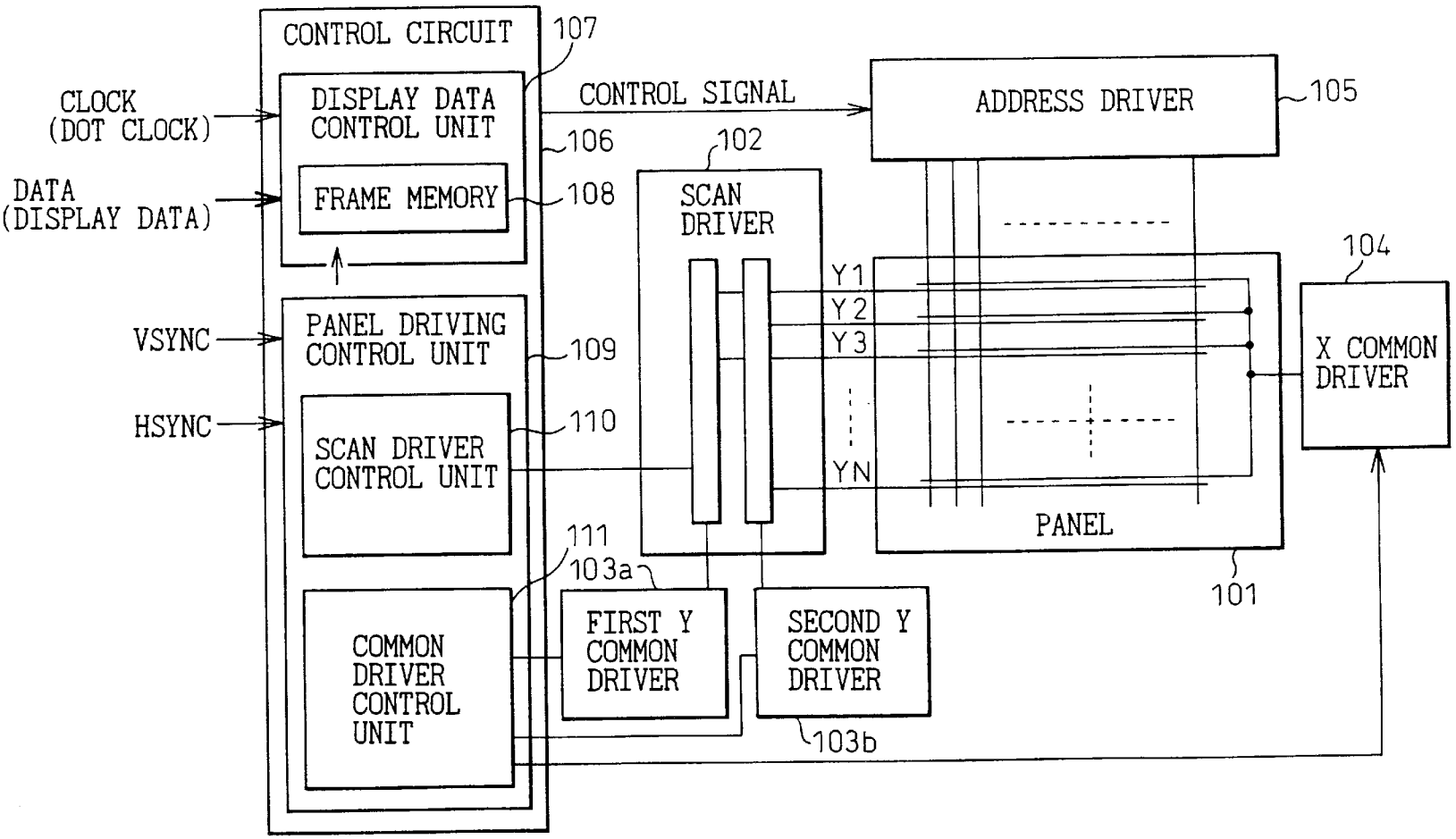
Fig.4 PRIOR ART
FIG. 4 is a schematic block diagram of a known interlacing display type PDP.

FIG. 4 is a schematic block diagram showing peripheral circuits enabling the PDP shown in FIGS. 1, 2, and 3 to achieve interlacing display. The addressing electrodes 13 are connected to an address driver 105 one by one. The address driver applies an addressing pulse during addressing discharge. The Y electrodes 11 are connected individually to a scan driver 102. The scan driver 102 is divided into a block for driving odd Y electrodes and a block for driving even Y electrodes. A Y common driver for producing a sustaining discharge pulse and applying it to the Y electrodes is also divided into first and second Y common drivers 103*a* and 103*b*. A scanning pulse to be applied during addressing discharge is generated by the scan driver 102. A sustaining pulse and the like are generated by the Y common drivers 103*a* and 103*b*, and applied to the Y electrodes 11 via the scan driver 102. The X electrodes 12 run over all display lines of the panel and are connected in common. An X common driver 104 generates a writing pulse, sustaining pulse, and the like. These driver circuits are controlled by a control circuit 106. The control circuit is controlled with synchronizing signals CLOCK, VSYNC, and HSYNC, and a display data signal DATA which are input externally to the display.

Figure 5:
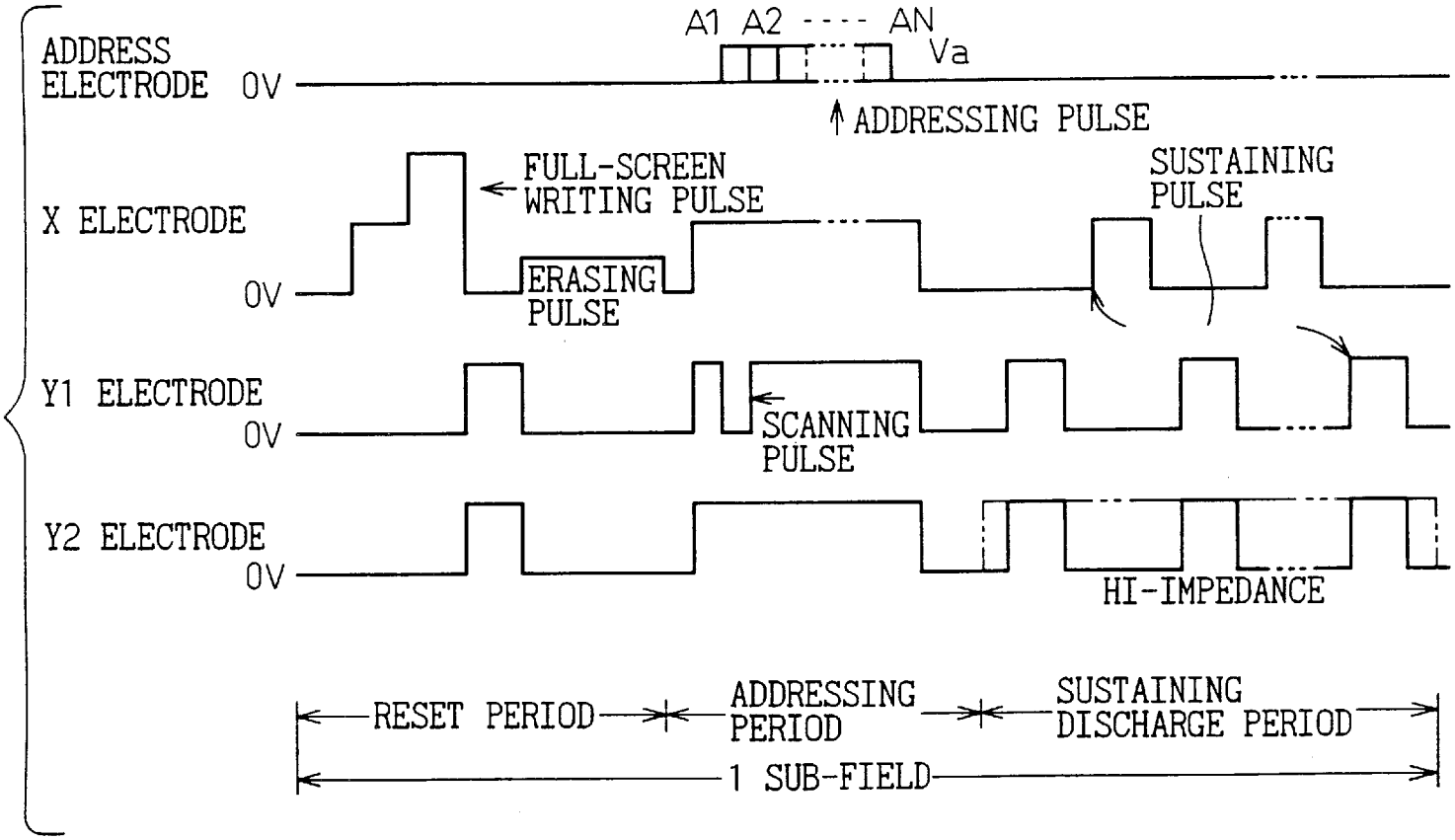
Fig. 5 PRIOR ART
FIG. 5 is a waveform diagram concerning a known driving method.

FIG. 5 is a waveform diagram concerning a known driving method according to which the PDP shown in FIGS. 1 to 3 achieves interlacing display using the circuits shown in FIG. 4. FIG. 5 is concerned with one sub-field employed in an "addressing/sustaining discharge separated writing addressing method." In this example, one sub-field is divided into a reset period, addressing period, and sustaining discharge period. During the reset period, first, all the Y electrodes are set to a level of 0 V. At the same time, a full-screen writing pulse of a voltage Vs+Vw (approximately 300 V) is applied to the X electrodes. Discharge is then sustained, and erasure discharge is carried out with an erasing pulse. The reset period exerts an effect of bringing all cells to the same state irrespective of their lit or unlit states during the previous sub-field, and contributes to stabilization of the next addressing (writing) discharge.

Thereafter, during the addressing period, addressing discharge is carried out line-sequentially so that the cells can be turned ON or OFF according to display data. First, a scan pulse is applied to the Y electrodes. An addressing pulse of a voltage Va (approximately 50 V) is applied selectively to addressing electrodes coincident with cells in which discharge is sustained, that is, cells to be lit among all the addressing electrodes. Discharge occurs between the addressing electrodes and Y electrode in the cells to be lit. With the discharge as priming, discharge occurs between the X electrode and Y electrode immediately. This causes wall charge to accumulate on the MgO surface over the X electrode and Y electrode in the selected cells on the selected line by an amount permitting sustaining of discharge.

The same operation is performed on the other display lines. Eventually, new display data is written on all the display lines.

Thereafter, during the sustaining discharge period, a sustaining pulse of a voltage Vs (approximately 180 V) is applied alternately to the Y electrodes and X electrodes. Discharge is therefore sustained. An image of one sub-field is then displayed. Since interlacing is adopted, Y electrodes coincident with display lines on which discharge is not induced are retained at high impedance in order to minimize a power consumption.

In the "addressing/sustaining discharge separated writing addressing method," a luminance level is determined with the length of a sustaining discharge period, that is, the number of sustaining pulses.

Figure 6:
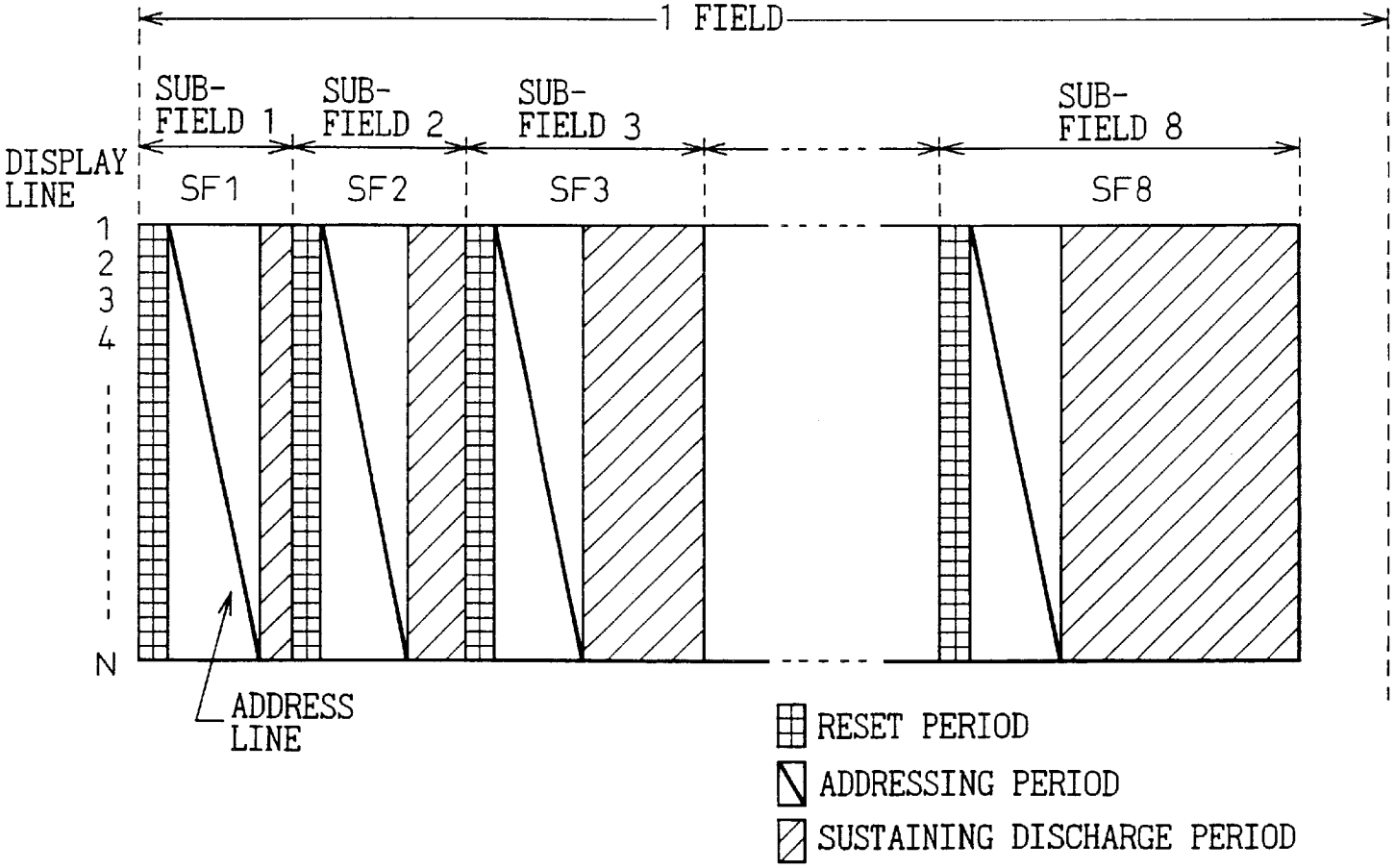
Fig. 6 PRIOR ART
FIG. 6 is a diagram showing a gray-scale display sequence.

To be more specific, a driving method for achieving 256-level gray-scale display is shown in FIG. 6 as an example of multilevel gray-scale display. In this example, one field is divided into eight sub-fields SF1, SF2, SF3, SF4, SF5, SF6, SF7, and SF8. Ones of odd display lines or even display lines are involved in display during one field. The other display lines are involved in display during a subsequent field.

Within the sub-fields SF1 to SF8, the reset periods and addressing periods have the same lengths. The lengths of the sustaining discharge periods have a ratio of 1:2:4:8:16:32:64:128. Thus, a difference in luminance can be expressed in the range of 256 levels from 0 to 255 by selecting the sub-fields during which cells are lit.

Figure 7:
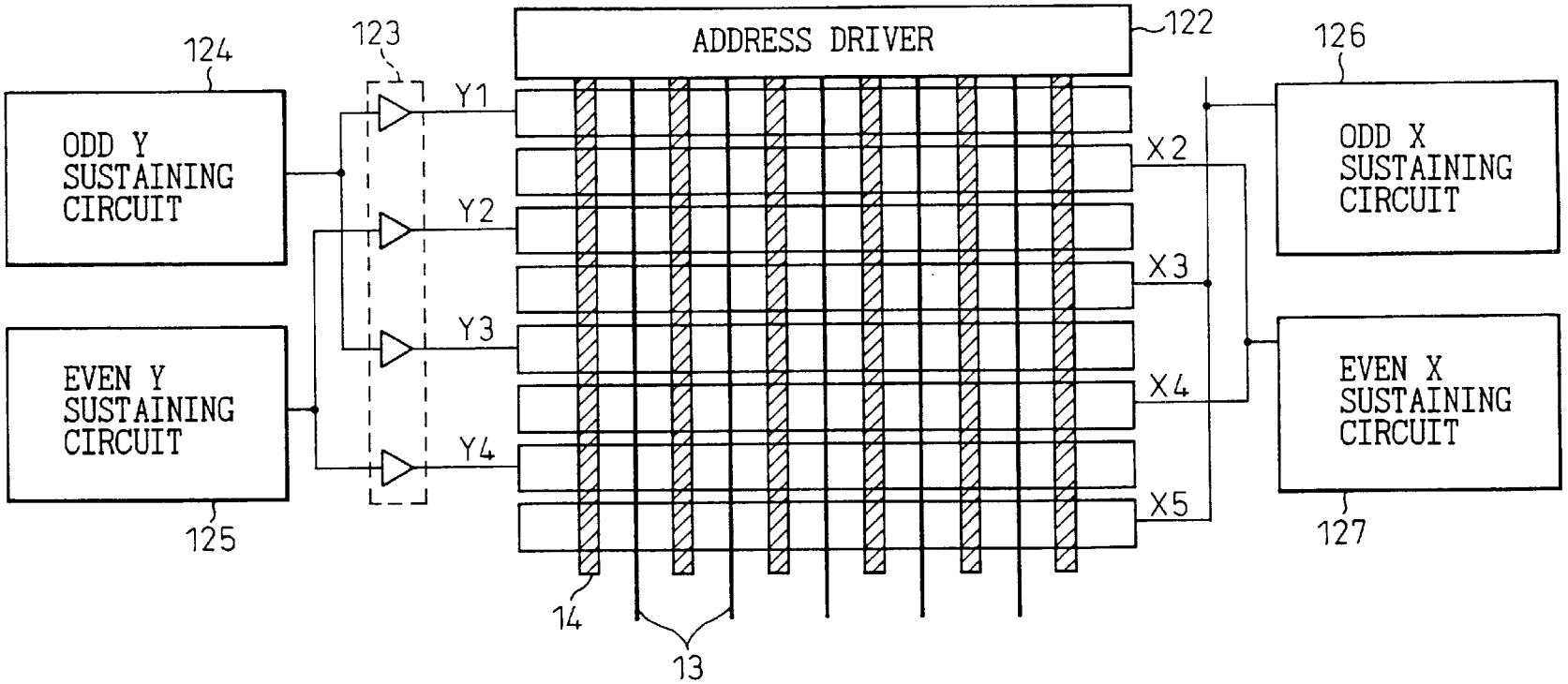
Fig. 7 PRIOR ART
FIG. 7 is a diagram showing a panel of a known interlacing display in which partitions parallel to Y electrodes and X electrodes are removed, and the configuration of drive circuits.
Figure 8:
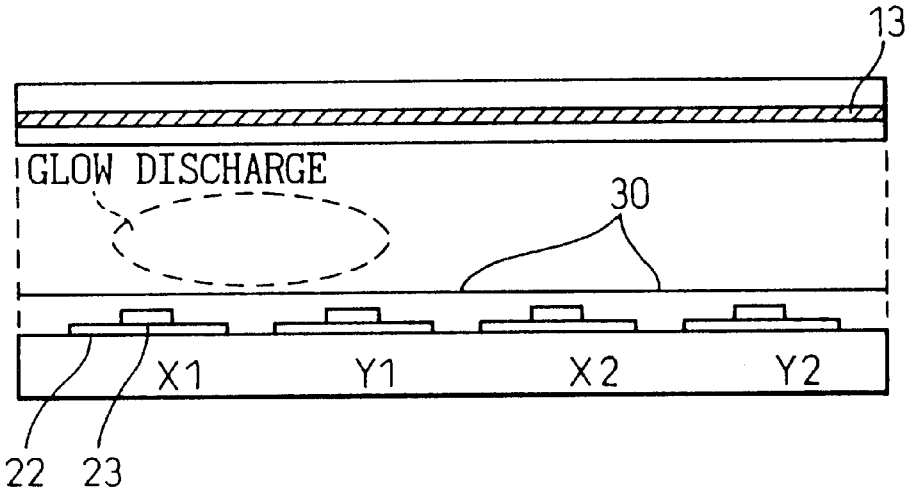
Fig.8 PRIOR ART
FIG. 8 is a sectional view of a panel in the known display shown in FIG. 7.
Figure 9:
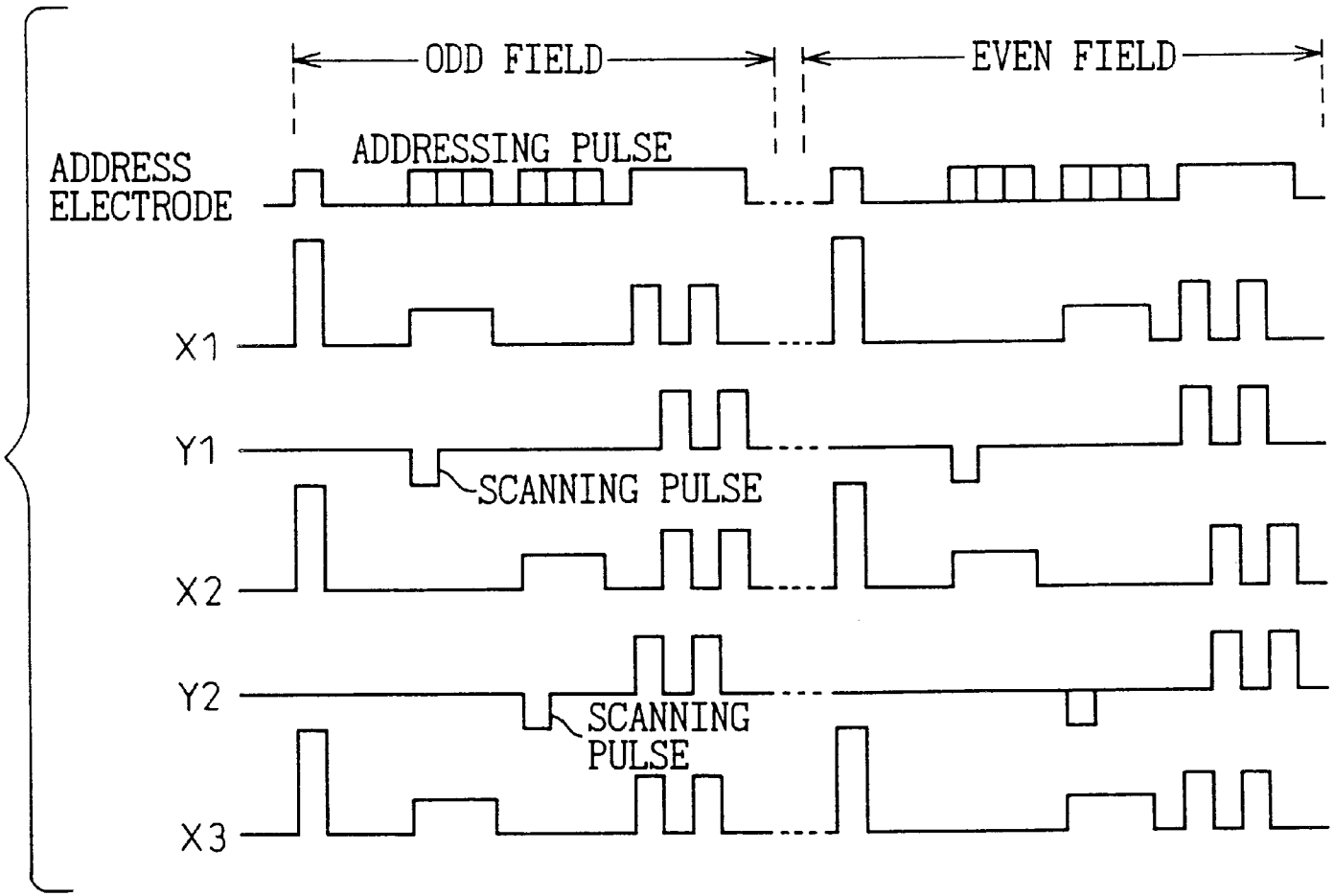
Fig. 9 PRIOR ART
FIG. 9 is a waveform diagram showing driving waves employed in the known display shown in FIG. 7.

FIGS. 7 to 11 are diagrams showing the configuration and structure of a plasma display adopting interlaced driving, which is disclosed in the aforesaid Japanese Patent Application No. 8-194320, and waveforms of the driving waves. FIG. 7 is a diagram schematically showing a panel for an interlaced display in which slits across each Y electrode are utilized as discharge slits, and the circuitry. FIG. 8 shows a sectional structure of the panel. FIG. 9 is a waveform diagram showing driving waves to be applied to electrodes which explains the driving method. The driving method features that when a voltage is selected and applied to an X electrode during addressing, it is determined in which of slits across a Y electrode discharge is triggered with discharge occurring between addressing electrodes and the Y electrode. Consequently, wall charge is formed in cells in the slit on the side on which discharge should be sustained. Sustaining pulses that are in phase with each other are applied to electrodes adjoining a slit in which discharge is not induced, whereby occurrence of incorrect discharge is prevented. The Y sustaining circuit and X sustaining circuit that are circuits for sustaining discharge are divided into an odd Y sustaining circuit 124 and even Y sustaining circuit 125, and an odd X sustaining circuit 126 and even X sustaining circuit 127. These circuits can independently apply pulses for addressing and sustaining operations.

In the disclosed plasma display, display lines associated with an odd field and even field do not affect each other. Partitions for defining display cells lengthwise need not be formed between the Y electrodes and X electrodes. Eventually, the plasma display panel can enjoy the feature of high definition.

Figure 10:
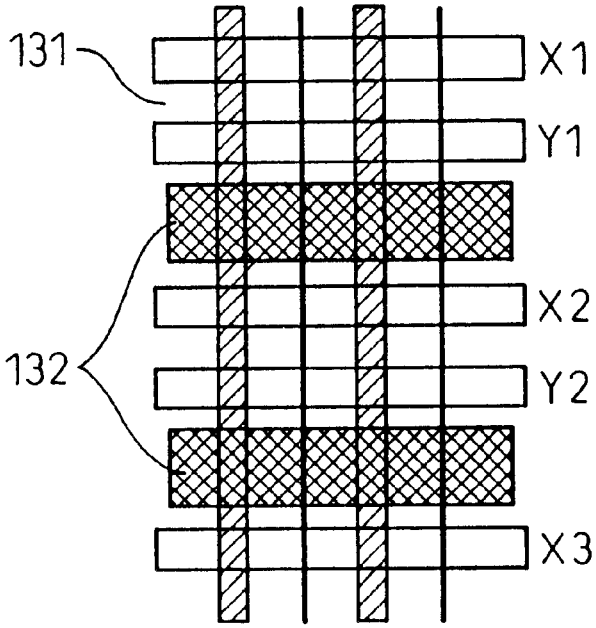
Fig.10 PRIOR ART
FIG. 10 is a diagram showing a structure in the known display in which light-interceptive members are included for improving contrast.

Furthermore, the Japanese Patent Application No. 8-194320 has disclosed an idea that light-interceptive members are placed in slits that are not involved in display in order to prevent a decrease in display contrast deriving from discharge irrelevant to display. FIG. 10 is a diagram showing a structure in which the light-interceptive members disclosed in the Japanese Patent Application No. 8-194320 are included. The plasma display panel shown in FIG. 10 is a known panel in which a slit between each pair of the Y electrodes and X electrodes shown in FIGS. 1 and 2 is used as a display slit 131. A light-interceptive member 132 is placed in a slit between each Y electrode and X electrode on different lines which is not a display slit. This helps minimize light reflected from slits that are not display slits.

In the plasma display, a discharge referred to as priming discharge is induced in order to facilitate smooth addressing discharge and sustaining discharge. In the prior art, for example, reset discharge to be carried out during a reset period plays the role of the priming discharge. The priming discharge does not contribute to a display image but deteriorates display contrast. For example, when priming discharge is induced between electrodes Y1 and X2, if the light-interceptive member 132 is placed between them, unwanted light irrelevant to display is intercepted.

As mentioned above, when the configuration shown in FIG. 7 is adopted, it becomes unnecessary to place partitions parallel to Y electrodes and X electrodes. A plasma display can enjoy the feature of high definition. However, there is a problem that connection between a scan driver that is a circuit for selecting a Y electrode and a Y sustaining circuit that is a discharge sustaining circuit or a Y common driver becomes complex. In the known displays shown in FIGS. 4 and 7, the Y electrodes are divided into odd and even Y electrodes and connected to respective sustaining circuits. In general, a scan driver is realized with an integrated circuit formed with, for example, one chip giving a 64-bit output. Therefore, when the scan driver is connected to the different sustaining circuits in relation to the respective bits, routing becomes complex. If an output of one chip is used exclusively for odd electrodes or even electrodes, connection between the sustaining circuits and scan driver is simplified, but connection between the scan driver and electrodes in the panel become complex. In either case, the display becomes complex. This becomes a factor of an increase in cost. Moreover, performance and reliability are deteriorated because of an increase in scale and complexity of routing. In an effort to solve this kind of problem, the Japanese Patent Application No. 8-194320 has disclosed a plasma display having the configuration shown in FIG. 11.

Figure 11:
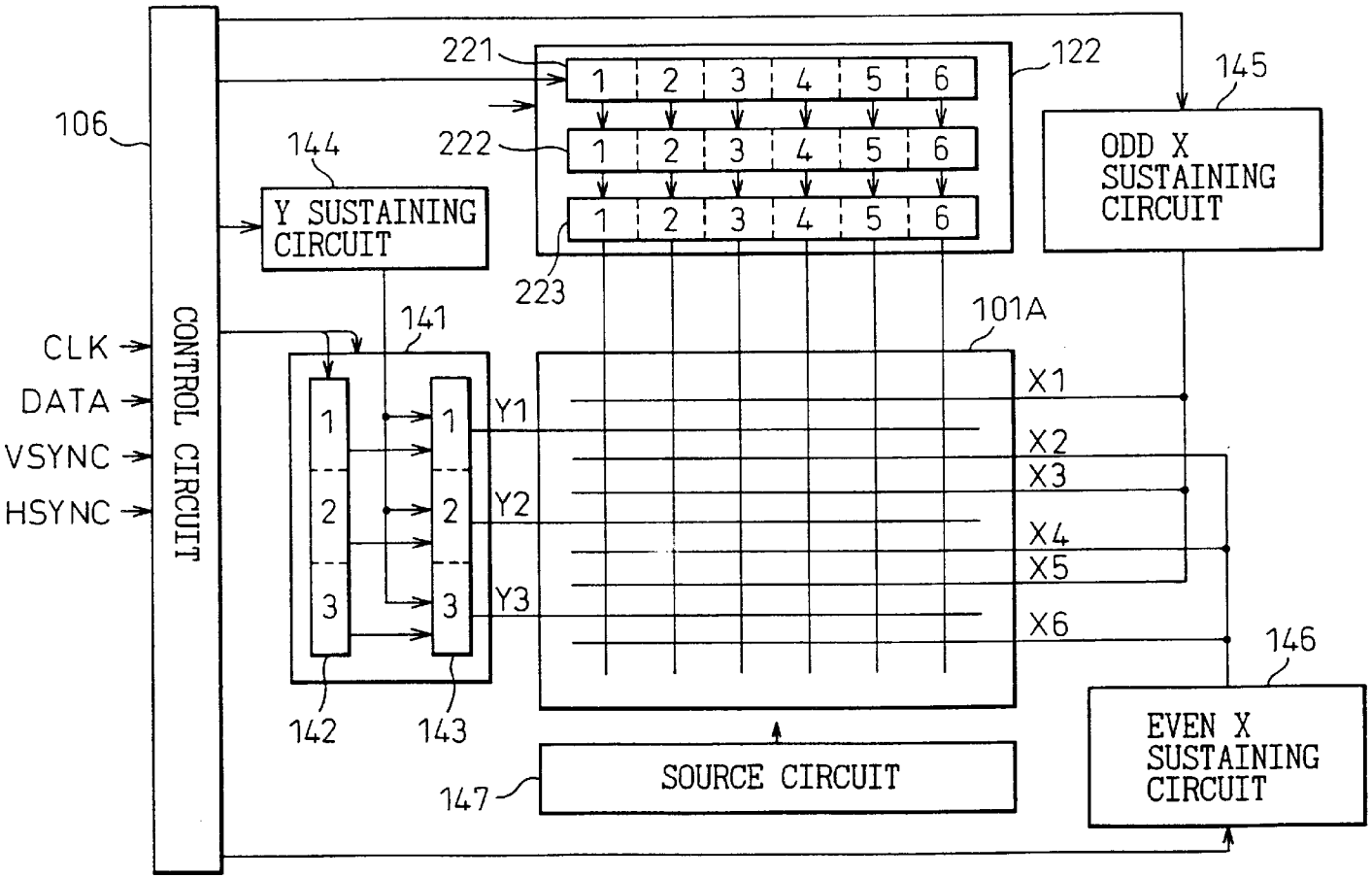
Fig.11 PRIOR ART
FIG. 11 is a diagram showing the configuration of another known plasma display for interlacing display.

In the plasma display shown in FIG. 11, two X electrodes are formed across each Y electrode in such a way that electrodes X1 and X2 are formed across electrode Y1, and electrodes X3 and X4 are formed across electrode Y2. During an odd field, voltages are applied to the Y electrodes and odd-numbered X electrodes in order to induce discharge. During an even field, voltages are applied to the Y electrodes and even-numbered X electrodes in order to induce discharge. Thus, an interlaced display is achieved. A complete non-display line is created between an even-numbered X electrode and odd-numbered X electrode. However, since no partition is placed, the feature of high definition can be realized. Besides, since it is unnecessary to separate the Y electrodes into two channels, connection between a scan driver and a Y sustaining circuit and connection between the scan driver and the panel become simple.

In the plasma display disclosed in the Japanese Patent Application No. 8-194320, large voltages are applied to the Y electrodes and X electrodes during a reset period in the same manner as they are in the known displays. Thus, full-screen writing is carried out. If discharge occurring during the reset period is regarded as priming discharge, priming discharge is induced at the same positions as display cells. As mentioned previously, priming discharge does not contribute to a display image but deteriorates display contrast. It is preferred to intercept the light. In the display disclosed in the Japanese Patent Application No. 8-194320, priming discharge is induced in display cells. Light-interceptive members cannot be formed in the display cells as shown in FIG. 10. The known display disclosed in the Japanese Patent Application No. 8-194320 confronts a problem that the display contrast cannot be improved fully.

When the driving method shown in FIG. 9 using full-screen writing discharge and full-screen self-erasure discharge as reset discharge, or the driving method shown in FIG. 5 in which full-screen writing, sustaining discharge, and erasure are carried out is adopted, reset discharge (priming discharge) is carried out in even slits in which discharge is not be induced. This results in deteriorated contrast. In these examples, since priming discharge is induced in display cells, the scale of the discharge is as large as that of sustaining discharge. This poses a problem in that a large amount of power is consumed.

Figures 12A, 12B, 12C:
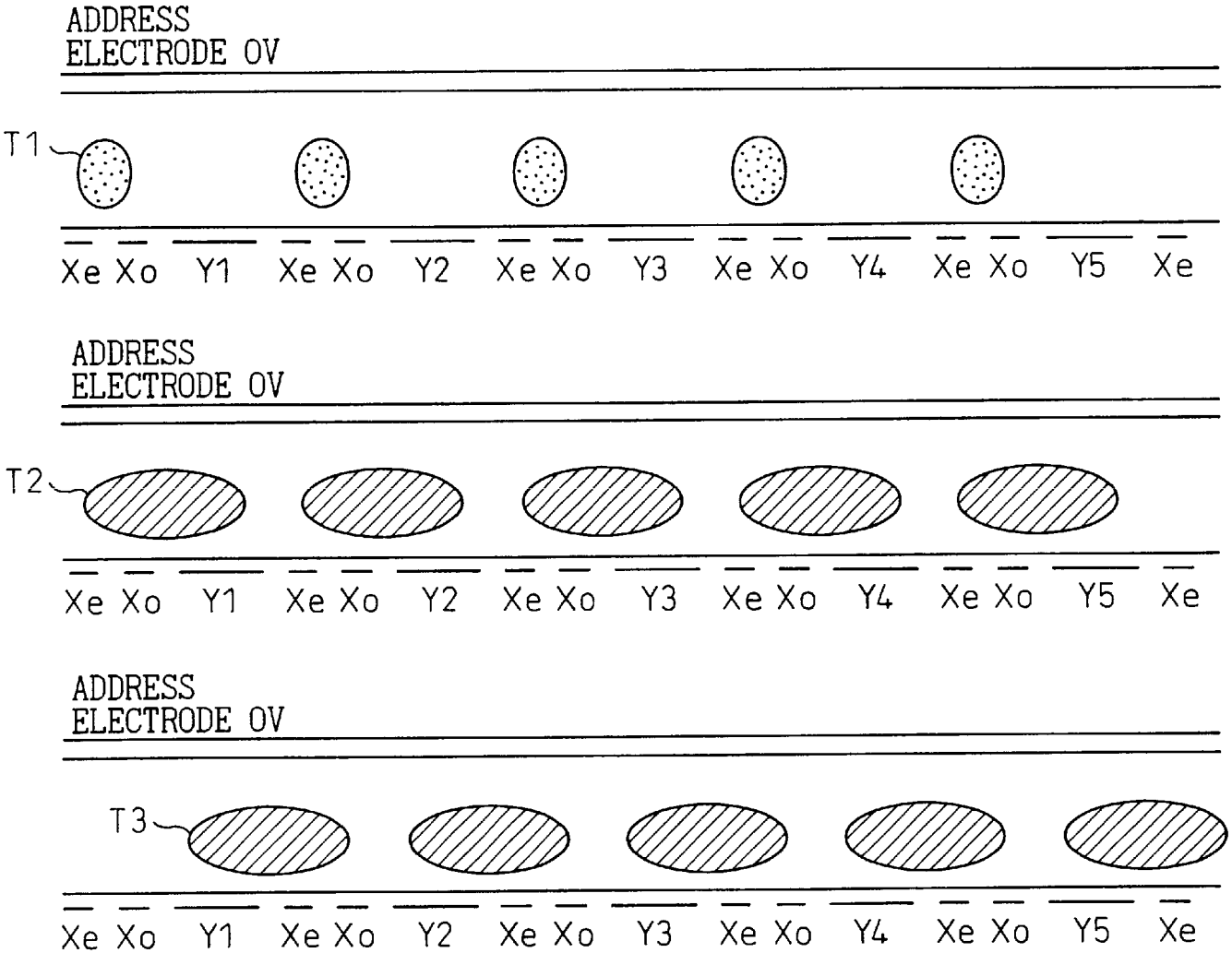
FIGS. 12A to 12C are diagrams showing glowing positions in accordance with the present invention.

FIGS. 12A to 12C are diagrams showing glowing (i.e., a glow discharge) positions in accordance with the present invention. In FIGS. 12A to 12C, there are shown first Y electrodes Y1, Y2, etc., second electrodes Xo, third electrodes Xe, third cells T1, first display cells T2 (display cells on odd lines: odd display cells), and second display cells T3 (display cells on even lines: even display cells). According to the present invention, priming discharge is induced in the third cells T1 between the second and third electrodes. It is therefore possible to include light-interceptive members so as to intercept light. Consequently, display contrast can be improved. Moreover, since priming discharge is induced in the third cells T1 that are not display cells, the scale of the discharge can be reduced and the power consumption can be minimized.

Figure 13:
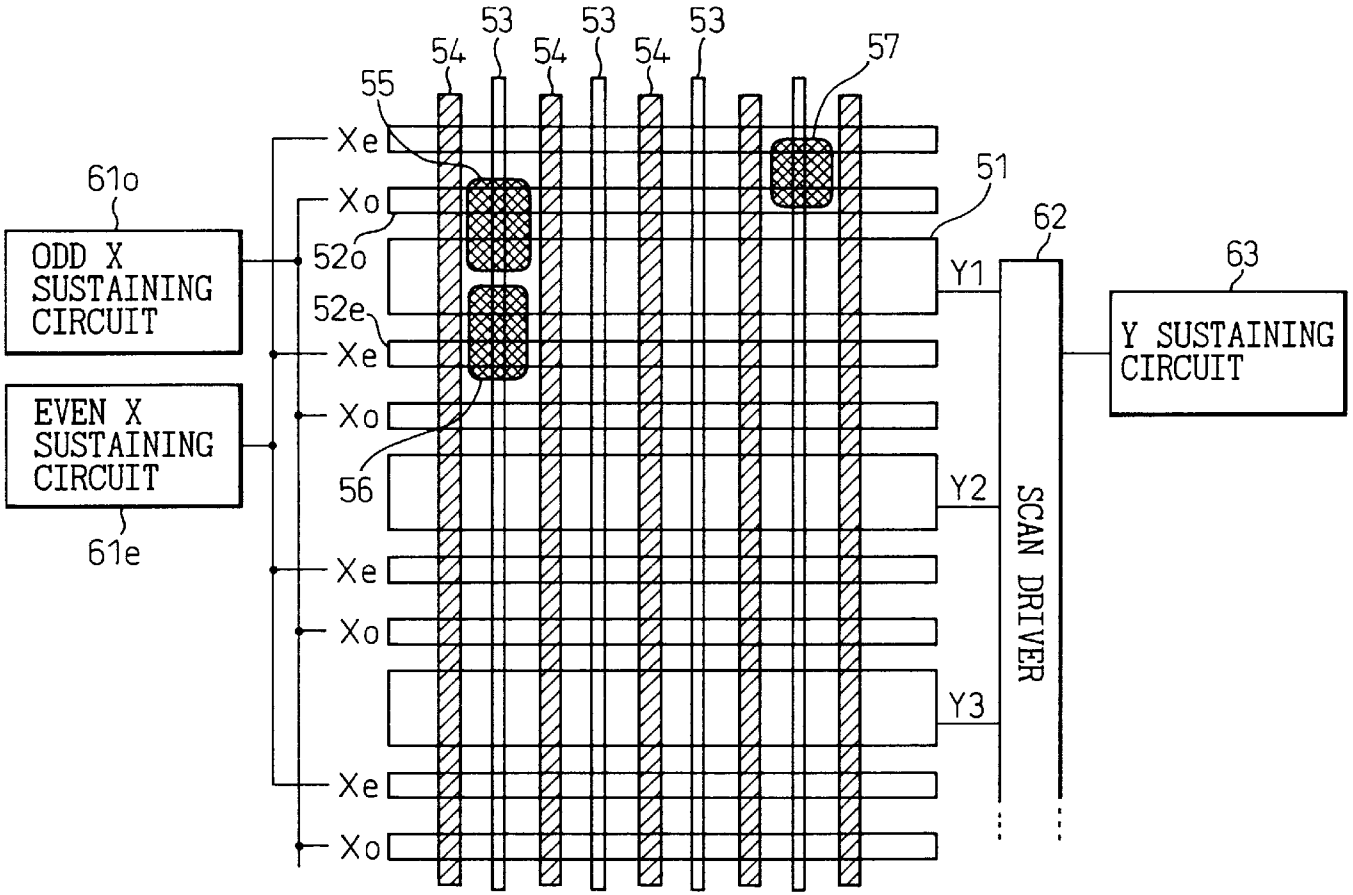
FIG. 13 is a diagram showing a plasma display panel of a first embodiment of the present invention, and the configuration of drive circuits.

FIG. 13 shows the configuration of a plasma display of a first embodiment of the present invention. The control unit and the like shown in FIG. 4 are omitted.

Figure 14:
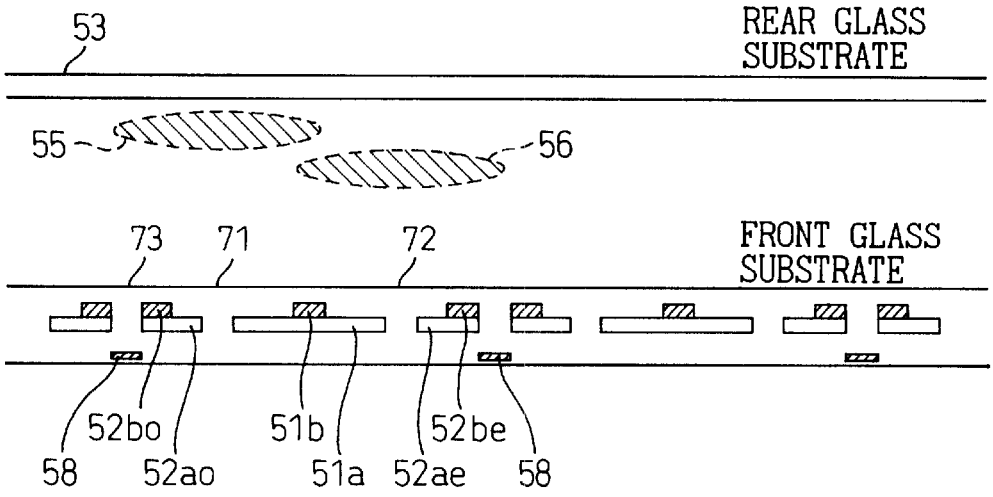
FIG. 14 is a diagram showing the structure of the panel of the first embodiment and glowing positions.

FIG. 14 shows a sectional structure of a plasma display panel of this display. Electrodes of this panel include wide Y electrodes 51, Xo electrodes 52*o* and Xe electrodes 52*e* a respective, individual pair of which sandwiches each Y electrode, and addressing electrodes 53. The Y electrodes 51 are composed of transparent electrodes 51*a* and metallic bus electrodes 51*b*. The Xo electrodes 52*o* are composed of transparent electrodes 52*ao* and metallic bus electrodes 52*bo*. The Xe electrodes 52*e* are composed of transparent electrodes 52*ae* and metallic bus electrodes 52*be*. The metallic bus electrodes are used to prevent a voltage drop. As illustrated, the transparent electrodes are wider than the bus electrodes. In the case of the Y electrodes 51, the bus electrodes 51*b* are formed in the centers of the transparent electrodes 51*a*. In the case of the Xo electrodes 52*o* and Xe electrodes 52*e*, the bus electrodes 52*bo* and 52*be* are formed on edges of the transparent electrodes 52*ao* and 52*ae* on the sides on which the electrodes are opposed to the X electrodes on adjoining lines. Herein, the width of the bus electrodes 51*b* of the Y electrodes 51 is equal to the sum of the width of the bus electrodes 52*bo* and 52*be*, and the width of light-interceptive members 58 each formed between X electrodes on adjoining lines. The thickness of the bus electrodes 51*b* of the Y electrodes 51 should preferably be half of the thickness of the bus electrodes 52*bo* and 52*be*. Consequently, the resistances of all the bus electrodes become the same.

First slits 71 are formed between the Xo electrodes 52*o* and Y electrodes 51. First cells (odd cells) 55 involved in display during an odd field are formed in the first slits 71. Second slits 72 are formed between the Xe electrodes 52*e* and Y electrodes 51. Second cells (even cells) 56 involved in display during an even field are formed in the second slits 72. Third slits 73 are formed between the Xo electrodes 52*o* and Xe electrodes 52*e*, and third cells 57 used for priming are formed in the third slits. Furthermore, the light-interceptive members 58 are formed in the third slits 73 in order to prevent light, which stems from priming discharge, from leaking out.

The Y electrodes are connected to a scan driver 62 serving as a selecting circuit, and connected as a whole to a Y sustaining circuit 63 for applying a signal used to sustain discharge. The scan driver 62 produces a scanning pulse. The Y sustaining circuit 63 produces a sustaining discharge pulse and applies it to the Y electrodes 51. On the other hand, the Xo electrodes 52*o* and Xe electrodes 52*e* are connected as a whole to an odd X sustaining circuit 61*o* and an even X sustaining circuit 61*e*, respectively, which apply signals used to sustain discharge. A drive circuit for driving the addressing electrodes is the same as those in the known displays, and therefore omitted.

Figure 15:
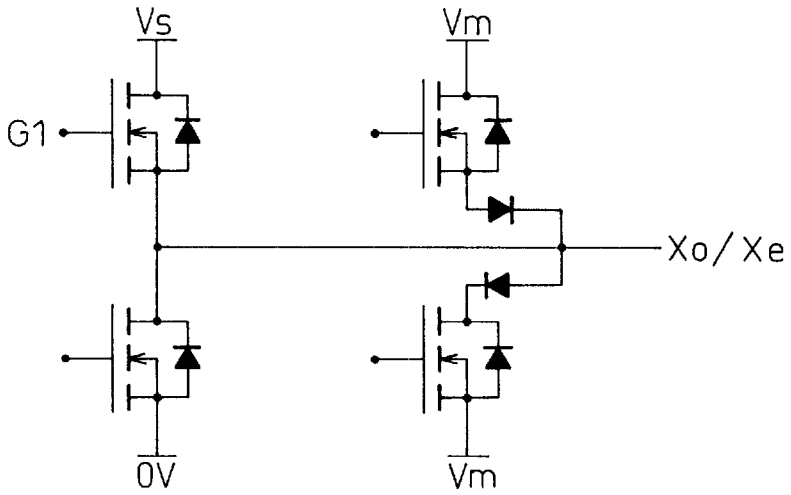
FIG. 15 is a diagram showing the components of an X sustaining circuit in the first embodiment.

FIG. 15 is a diagram showing the details of the odd X sustaining circuit 61*o* and even X sustaining circuit 61*e*. A voltage Vs is a voltage of a sustaining discharge pulse, a voltage Vm is a voltage to be applied to electrodes, which are not involved in discharge, during a sustaining discharge period.

Figure 16:
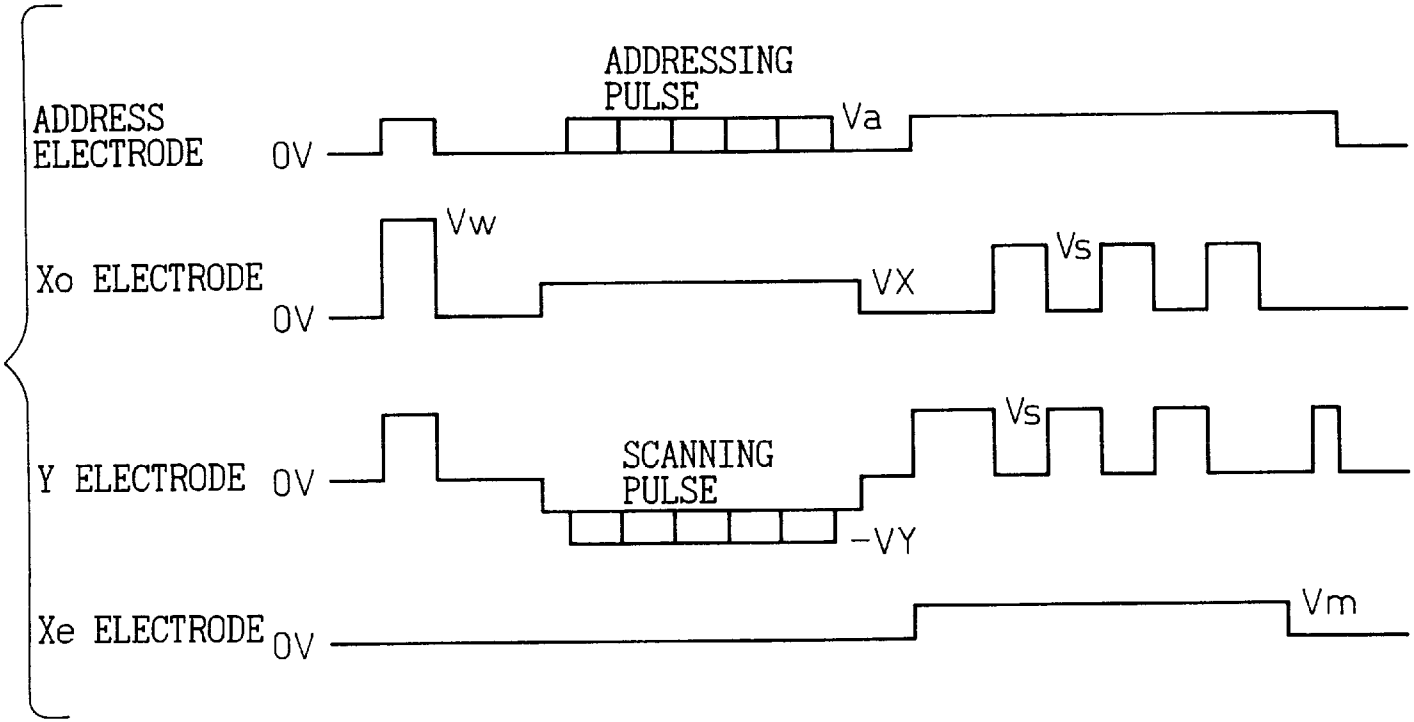
FIG. 16 is a waveform diagram showing driving waves (odd field) employed in the first embodiment.

FIG. 16 is a waveform diagram of driving waves to be applied to electrodes which shows operations carried out in the display, wherein the timing of the waves during one sub-field within an odd field is shown. First of all, a pulse of a voltage Vw (approximately 300 V) is applied to the Xo electrodes 52*o*. The pulse induces discharge in the third cells 57 between the Xo electrodes 52*o* and Xe electrodes 52*e*. Since a voltage Vs is applied to the Y electrodes 51, discharge does not occur in the first and second cells 55 and 57. With the discharge, wall charge is accumulated on the surface of the dielectric layer over the Xo electrodes 52*o* and Xe electrodes 52*e*. The pulse is removed in approximately 10 microseconds. According to the timing that all the electrodes are set. to 0 V, discharge recurs due to the voltage of the wall charge itself. This discharge does not cause wall charge to accumulate because a potential difference among the electrodes is 0 V, but terminates with a neutralization of space charge. However, a little space charge is not neutralized but floats in the air and works effectively as priming during addressing discharge.

During an addressing period, a scanning pulse (−150 V) is applied to the Y electrodes 51 successively one at a time.

An addressing pulse (50 V) is selectively applied to the addressing electrodes 53 coincident with cells to be lit. This induces discharge between the addressing electrodes and a Y electrode. At this time, since the Xe electrodes 52*e* are set to 0 V, and a voltage VX (50 V) is applied to the Xo electrodes 52*o* during an odd field, the discharge occurring between the addressing electrodes 53 and Y electrode 51 triggers discharge between an Xo electrode 52*o* and the Y electrode 51, that is, in first cells 55. With the discharge, wall charge permitting sustaining of discharge during a sustaining discharge period is formed. The above operation is repeated, whereby writing display data for a whole screen is completed.

During a sustaining discharge period, sustaining discharge pulses are applied alternately to the Y electrodes 51 and Xo electrodes 52*o* one at a time. Thus, sustaining of discharge is repeated in cells in which data has been written. An intermediate voltage (Vm) of the sustaining discharge pulses is applied to the Xe electrodes 52*e*. Incorrect discharge will therefore not occur in the second cells 56. Finally, a short-duration erasing pulse is applied to the Y electrodes 51. Thus, the wall charge is erased.

Figure 17:
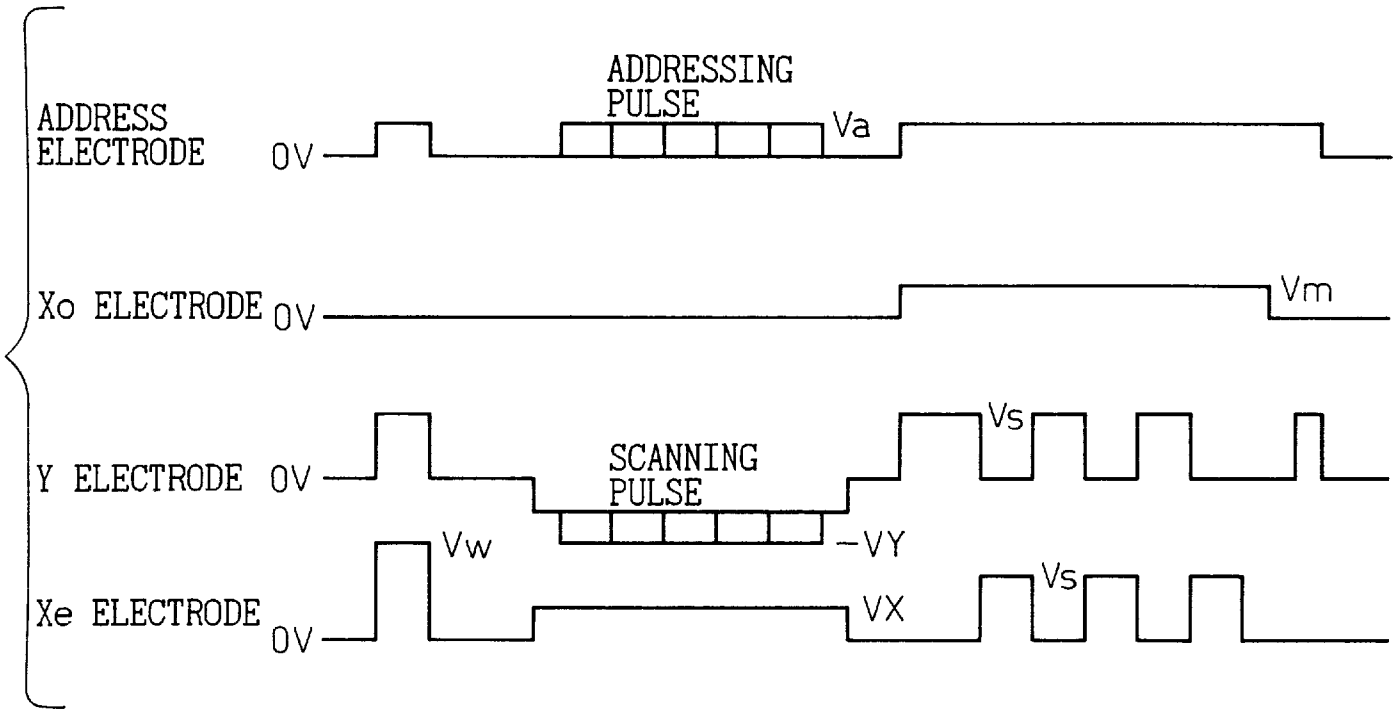
FIG. 17 is a waveform diagram showing driving waves (even field) employed in the first embodiment.

FIG. 17 is a waveform diagram of driving waves to be applied during an even field. During a reset period, a pulse is applied to the Xe electrodes 52*e*. During an addressing period, a voltage VX is applied to the Xe electrodes 52*e* in order to form wall charge in the second cells 56. During a sustaining discharge period, a voltage Vm is applied to the Xo electrodes 52*e* in order to prevent incorrect discharge from occurring in the first cells 55.

Figure 18:
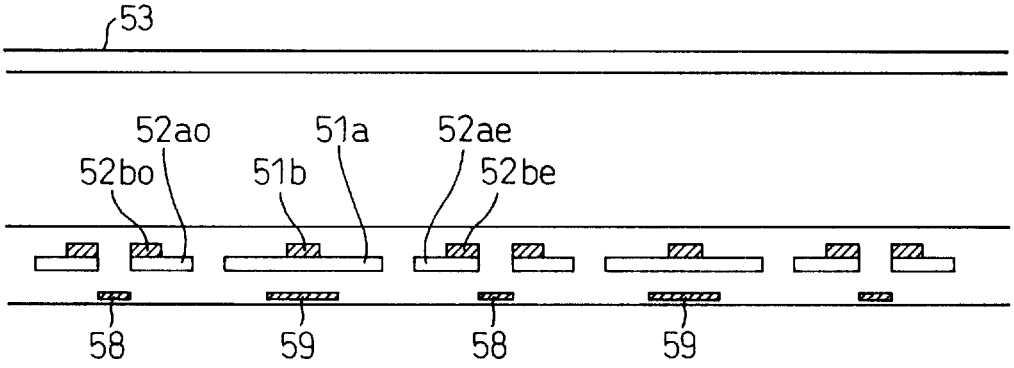
FIG. 18 is a diagram showing the structure of a panel of a second embodiment of the present invention.

FIG. 18 shows the structure of a panel of a second embodiment of the present invention. The configuration of the display and the driving method adopted are identical to those of the first embodiment. The panel has light-interceptive members 59 formed at the positions of the Y electrodes 51. The width of the light-interceptive members 59 is the same as the sum of the widths of the bus electrodes 52*bo* and 52*be* of the Xe electrodes 52*e* and Xo electrodes 52*o*, and the width of the light-interceptive members 59. Consequently, the outlines of light emanating from the first cells 55 and second cells 5 are seen arranged equidistantly and well-balanced from the centers of first and second slits.

Figure 19:
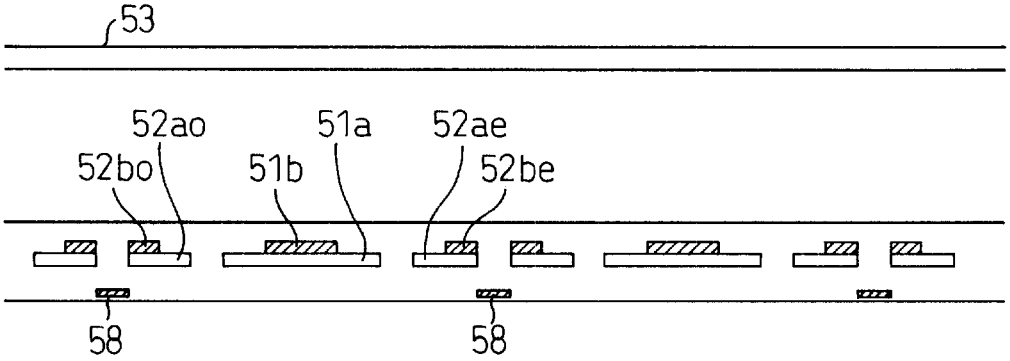
FIG. 19 is a diagram showing the structure of a panel of a third embodiment of the present invention.

FIG. 19 shows the structure of a panel of a third embodiment of the present invention. The configuration of the panel and the driving method adopted are identical to those in the first embodiment. In this panel, the width of the bus electrodes 51*b* of the Y electrodes 51 is the same as the sum of the widths of the bus electrodes 52*bo* and 52*be* of the Xe electrodes and Xo electrodes on adjoining lines, and the width of the light-interceptive members 58. Consequently, similarly to the second embodiment, the outlines of light emanating from the first cells and second cells are seen arranged equidistantly and well-balanced from the centers of first and second slits.

Figure 20:
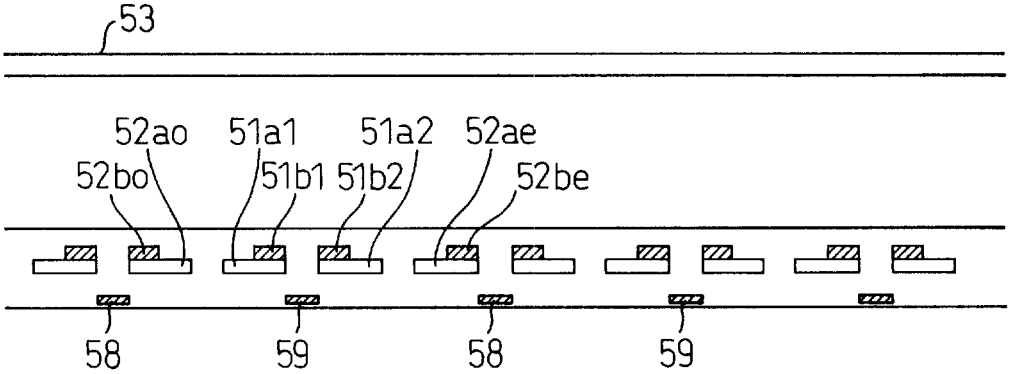
FIG. 20 is a diagram showing the structure of a panel of a fourth embodiment of the present invention.

FIG. 20 shows the structure of a panel of a fourth embodiment of the present invention. The configuration of the panel and the driving method adopted are identical to those in the first embodiment. This panel has fourth slits formed in the centers of the Y electrodes 51. Owing to the slits, it can be prevented that discharge spreads over the Y electrodes alone. Moreover, the outlines of light emanating from the first cells and second cells are seen arranged equidistantly and well-balanced from the centers of first and second slits. Besides, discharge can be stabilized.

Figure 21:
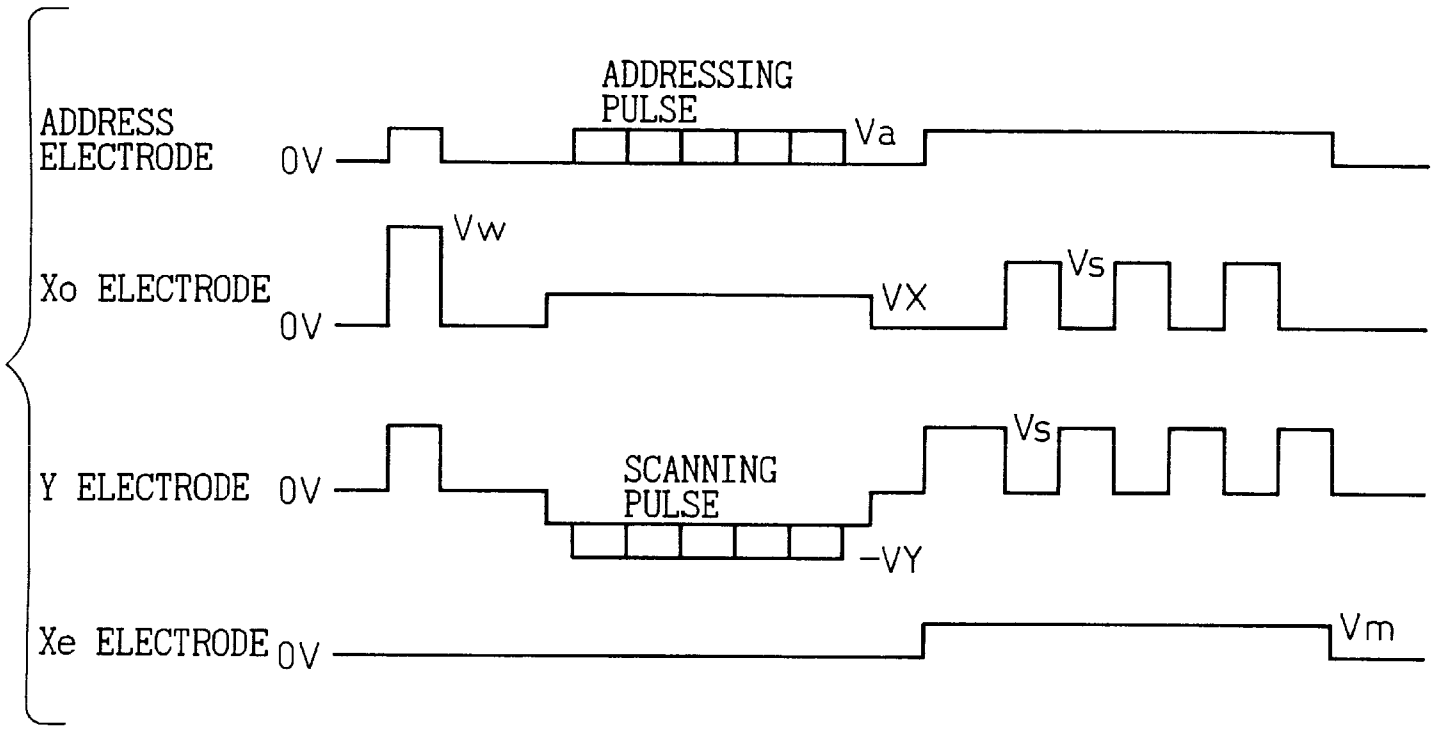
FIG. 21 is a waveform diagram showing driving waves employed in a fifth embodiment of the present invention and FIG. 22 is a waveform diagram showing driving waves employed in a sixth embodiment of the present invention.

FIG. 21 is a diagram showing waveforms of driving waves applied in a fifth embodiment of the present invention. Except for the point that the waveforms are different, the display of the fifth embodiment is identical to the one of the first embodiment. FIG. 21 shows the timing of driving waves during one sub-field within an odd field. In this embodiment, a sustaining discharge process is terminated by applying a last sustaining discharge pulse to the Y electrodes. Negative wall charge is therefore formed on the Y electrodes in lit cells, and positive wall charge is formed on the Xo electrodes therein. In a reset process, a pulse of a voltage Vw is applied to the Xo electrodes. This causes discharge to start in the third cells. Negative charge on the Y electrodes in cells, in which discharge is sustained immediately previously and wall charge is held, works on space charge that floats due to the discharge, whereby the wall charge is neutralized. After the pulse is removed, self-erasure discharge is carried out in the third cells in the same manner as in the first embodiment.

Figure 22:
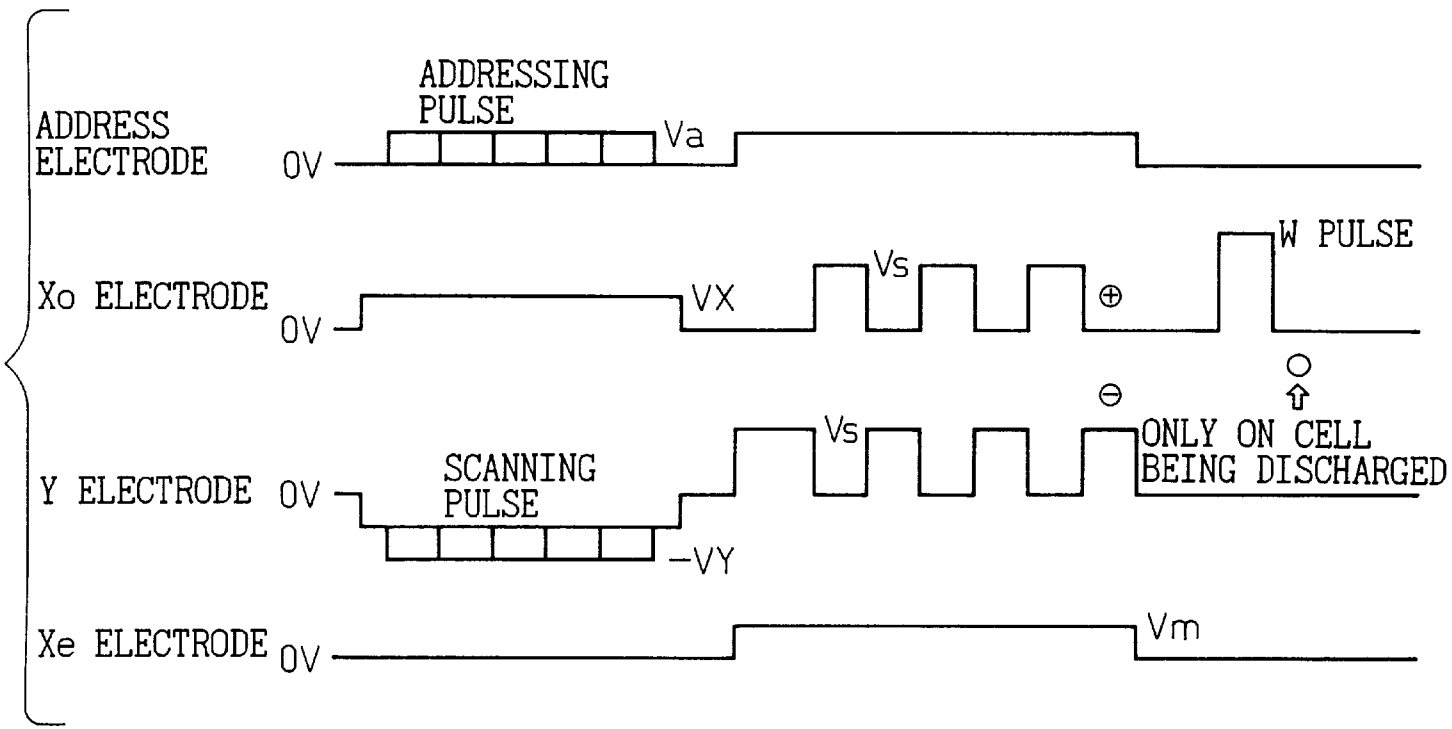

FIG. 22 is a diagram showing waveforms of driving waves employed in a sixth embodiment of the present invention, wherein the timing of the driving waves during one sub-field within an odd field is illustrated. In a panel employed in this embodiment, the width of the third slits is approximately half of that in the panel of the previous embodiment. In this embodiment, a sustaining discharge process is completed by applying a last sustaining discharge pulse to the Y electrodes. In lit cells, negative wall charge is formed on the Y electrodes, while positive wall charge is formed on the Xo electrodes. In a reset process, a pulse of a voltage Vw is applied to the Xo electrodes. The voltage is set to a value lower than the voltage Vw in the previous embodiment. Despite the low voltage, since the width of the third slits is small, discharge can be started successfully. In the third cells, discharge is started, and wall charge is accumulated. When the pulse is removed, self-erasure discharge is carried out. In cells in which discharge is sustained immediately previously and negative wall charge is accumulated, self-erasure discharge is also carried out for erasure.

Even in the panel of the first embodiment, when one field shifts to another, display cells are reset by applying a main pulse of a high voltage.

As described so far, according to the present invention, a plasma display having simplified drive circuits, costing little, being capable of minimizing invalid glowing, providing high contrast, and achieving interlacing display can be realized.

What is claimed is:

1. A plasma display, comprising:

a plasma display panel in which first, second, and third electrodes are arranged alternately and in parallel to one another on a first substrate, and fourth electrodes are arranged orthogonally to, and separated by a dielectric layer from, said first, second and third electrodes;

a first electrode selection driving circuit selectively driving said first electrodes;

a second electrode driving circuit driving said second electrodes;

a third electrode driving circuit driving said third electrodes;

first display cells formed at intersection between said first electrodes, said second electrodes and said fourth electrodes, second display cells formed at intersections between said first electrodes, said third electrodes and said fourth electrodes and third cells formed between said second electrodes and said third electrodes;

said first display cells and said second display cells alternately and repeatedly undergoing glow discharges to produce an interlaced display; and during a reset period, said second electrode driving circuit and said third electrode driving circuit applying voltages to said second and third electrodes, respectively, to induce priming discharges in said third cells.

2. A plasma display according to claim 1, wherein light-interceptive members are formed in third slits comprising gaps between said second and third electrodes.

3. A plasma display according to claim 2, wherein during a sustaining discharge period, said first electrode selection driving circuit applies a first sustaining discharge pulse to said first electrodes, one of said second electrode driving circuit and third electrode driving circuit applies a sustaining discharge pulse that is out of phase with said first sustaining discharge pulse, and the other one thereof applies a given constant voltage or keeps associated electrodes at high impedance.

4. A plasma display according to claim 3, wherein said given constant voltage is a voltage that is substantially half of the voltage of said first sustaining discharge pulse.

5. A plasma display according to claim 2, wherein first slits comprising gaps between said first and second electrodes and second slits comprising gaps between said first and third electrodes are arranged equidistantly.

6. A plasma display according to claim 5, wherein said third slits are disposed at the middles of said adjoining first electrodes.

7. A plasma display according to claim 2, wherein said first to third electrodes are composed of transparent electrodes and metallic bus electrodes.

8. A plasma display according to claim 7, wherein said transparent electrodes of said first electrodes are wider than said bus electrodes, and said bus electrodes are formed in the centers of said transparent electrodes.

9. A plasma display according to claim 7, wherein said transparent electrodes of said second and third electrodes are wider than said bus electrodes, and said bus electrodes are formed on the third slit sides.

10. A plasma display according to claim 5, the width of said bus electrodes of said first electrodes is the same as a dimension from an edge on the first slit side of the bus electrode of each second electrode to an edge on the second slit side of the bus electrode of each third electrode on an adjoining line.

11. A plasma display according to claim 10, wherein the thickness of said bus electrodes of said first electrodes is substantially half of the thickness of said bus electrodes of said second and third electrodes.

12. A plasma display according to claim 10, wherein the resistances of said first to third electrodes are the same.

13. A plasma display according to claim 2, wherein light-interceptive members are formed on said first electrodes.

14. A plasma display according to claim 6, wherein light-interceptive members are formed on said first electrodes.

15. A plasma display according to claim 14, wherein the width of said light-interceptive members on said first electrodes is the same as a dimension from an edge on the first slit side of the bus electrode of each second electrode to an edge on the second slit side of the bus electrode of each third electrode on an adjoining line.

16. A plasma display according to claim 15, wherein the width of said third slits is smaller than the width of said first and second slits.

17. A plasma display according to claim 5, wherein fourth slits are formed in the centers of said first electrodes.

18. A plasma display according to claim 17, wherein light-interceptive members are formed in said fourth slits in the centers of said first electrodes.

19. A driving method for a plasma display including a plasma display panel in which first, second, and third electrodes are arranged alternately and in parallel to one another on a first substrate, and fourth electrodes are arranged orthogonally to, and separated by a dielectric layer from, said first, second and third electrodes and having first display cells formed at intersections between said first electrodes, said second electrodes and said fourth electrodes, second display cells formed at intersections between said first electrodes, said third electrodes and said fourth electrodes, and third cells formed between said second electrodes and said third electrodes, said driving method comprising:

alternately and repeatedly allowing said first cells and second cells to glow for display for the purpose of achieving an interlaced display and said driving method further comprising:

a reset process in which the states of all display cells are made uniform, an addressing process in which display data is written, and a sustaining discharge process in which discharge is sustained in cells to be lit are carried out repeatedly, and in a sustaining discharge process in which discharges are sustained in said first display cells, a sustaining discharge pulse that is out of phase with a sustaining discharge pulse to be applied to said first electrodes is applied to said second electrodes, and the potential at said third electrodes is set to a given value lower than the voltage of said sustaining discharge pulse;

in a sustaining discharge process in which discharges are sustaining in said second display cells, a sustaining discharge pulse that is out of phase with a sustaining discharge pulse to be applied to said first electrodes is applied to said third electrode, and the potential at said second electrode is set to a given value lower than the voltage of said sustaining discharge pulse; and in the reset process, priming discharges are induced by applying voltages to said second and third electrode, and third cells for priming are formed with said second and third electrodes.

20. A driving method for a plasma display according to claim 19, wherein light emanating from third slits, comprising gaps between said second and third electrodes, is intercepted.

21. A driving method for a plasma display according to claim 20, wherein said given voltage to be applied to said third electrodes at the time of sustaining discharge in said first display cells, and said given voltage to be applied to said second electrodes at the time of sustaining discharge in said second display cells are each substantially half of the voltages to be applied to said first and second electrodes or to said first and third electrodes for sustaining discharge.

22. A driving method for a plasma display according to claim 20, wherein when discharge is sustained in said first display cells and when discharge is sustained in said second display cells, said second electrodes or third electrodes are retained at high impedance.

23. A driving method for a plasma display according to claim 20, wherein the voltage applied to said first electrodes at the time of inducing priming discharge in the reset process is a substantially intermediate voltage of the voltages to be applied to said second and third electrodes.

24. A driving method for a plasma display according to claim 23, wherein the voltage applied to said first electrodes at the time of inducing priming discharge in the reset period is the same as the voltage of said sustaining discharge pulse.

25. A driving method for a plasma display according to claim 20, wherein the polarity of voltages to be applied to said second and third electrodes in order to induce priming discharge is changed from when said first display cells are allowed to glow for display to when said second cells are allowed to glow for display.

26. A driving method for a plasma display according to claim 20, wherein the polarity of voltages to be applied to said second and third electrodes in order to induce priming discharge is opposite to that of a last sustaining discharge pulse applied in a sustaining discharge process immediately preceding the priming discharge.

27. A driving method for a plasma display according to claim 26, wherein, for inducing priming discharge, the potential at said first electrodes is set to the value attained on the last sustaining discharge stage within an immediately preceding sustaining discharge process, and a voltage of opposite polarity is applied to said second or third electrodes.

28. A driving method for a plasma display according to claim 20, wherein: for inducing priming discharge, a pulse is applied to said third cells in order to start discharge; and after the pulse is removed, a pulse having a voltage capable of inducing discharge again is applied in order to induce priming discharge.

29. A driving method for a plasma display according to claim 28, wherein after the pulse capable of inducing priming discharge is removed, all the electrodes have no potential difference.

30. A driving method for a plasma display according to claim 20, wherein: a pulse whose polarity is opposite to that of a voltage applied on the last sustaining discharge stage within an immediately preceding sustaining discharge process is applied in order to induce priming discharge; and after the pulse is removed, a pulse having a voltage capable of inducing discharge again and of inducing discharge even in said first or second display cells in which discharge is sustained immediately previously is applied.

31. A driving method for a plasma display according to claim 20, wherein immediately before display involving said first display cells shifts to display involving said second display cells, and immediately before display involving said second display cells shifts to display involving said first display cells, a pulse having a voltage capable of inducing discharge in all the cells is applied.

32. A driving method for a plasma display according to claim 20, wherein: immediately before display involving said first display cells shifts to display involving said second display cells, a pulse having a voltage capable of inducing discharge in said second display cells and third display cells is applied; and immediately before display involving said second display cells shifts to display involving said first display cells, a pulse having a voltage capable of inducing discharge in said first display cells and third display cells is applied.

33. A driving method for a plasma display according to claim 20, wherein at the end of the sustaining discharge process, an erasing pulse is applied to said first electrodes and said second electrodes or third electrodes.

* * * * *

UNITED STATES PATENT AND TRADEMARK OFFICE

CERTIFICATE OF CORRECTION

PATENT NO. : 6,288,692 B1
DATED : September 11, 2001
INVENTOR(S) : Yoshikazu Kanazawa et al.

It is certified that error appears in the above-identified patent and that said Letters Patent is hereby corrected as shown below:

Title page,
Item [56], References Cited, under FOREIGN PATENT DOCUMENTS, change "7-26169" to -- 7-261699 --.

Signed and Sealed this

Fourteenth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,288,692 B1
APPLICATION NO. : 08/887371
DATED : September 11, 2001
INVENTOR(S) : Yoshikazu Kanazawa et al.

It is certified that error appears in the above-identified patent and that said Letters Patent is hereby corrected as shown below:

Title page, item [56] References Cited, under Other Publications, insert – Harada et al., 40in. Color AC Plasma Displays, '96 Conference of Electrical society of Japan, Page 3-25 through 3-28--

Signed and Sealed this

Twenty-second Day of August, 2006

JON W. DUDAS
*Director of the United States Patent and Trademark Office*